US011033166B2

(12) United States Patent
Juettner et al.

(10) Patent No.: US 11,033,166 B2
(45) Date of Patent: Jun. 15, 2021

(54) FLOOR TREATMENT SYSTEM

(71) Applicant: ALFRED KARCHER SE & CO. KG, Winnenden (DE)

(72) Inventors: Steffen Juettner, Pliezhausen (DE); Patrick Prasser, Essen (DE); Heiko Blumhardt, Remseck (DE); Barbara Pfister, Weissach im Tal (DE); Christoph Waller, Schwaikheim (DE); Frank Nonnenmann, Schorndorf (DE)

(73) Assignee: ALFRED KÄRCHER SE & CO. KG, Winnenden (DE)

( * ) Notice: Subject to any disclaimer, the term of this patent is extended or adjusted under 35 U.S.C. 154(b) by 404 days.

(21) Appl. No.: 16/178,859

(22) Filed: Nov. 2, 2018

(65) Prior Publication Data

US 2019/0069746 A1 Mar. 7, 2019

Related U.S. Application Data

(63) Continuation of application No. PCT/EP2017/059347, filed on Apr. 20, 2017.

(30) Foreign Application Priority Data

May 4, 2016 (DE) ..... 202016102396.3

(51) Int. Cl.
*A47L 11/14* (2006.01)
*A47L 11/40* (2006.01)
*A47L 11/30* (2006.01)

(52) U.S. Cl.
CPC ..... *A47L 11/145* (2013.01); *A47L 11/30* (2013.01); *A47L 11/302* (2013.01); *A47L 11/40* (2013.01);

(Continued)

(58) Field of Classification Search
CPC ..... A47L 11/145; A47L 11/40; A47L 11/30; A47L 11/302; A47L 11/4083; A47L 11/4091; A47L 2201/024; A47L 2201/026
See application file for complete search history.

(56) References Cited

U.S. PATENT DOCUMENTS 5,572,759 A 11/1996 Zachhuber
5,959,423 A 9/1999 Nakanishi et al.
(Continued)

FOREIGN PATENT DOCUMENTS

CN 1551740 12/2004
CN 1665438 9/2005
(Continued)

OTHER PUBLICATIONS

U.S. Appl. No. 16/178,836, filed Nov. 2, 2018, Juettner et al.
(Continued)

*Primary Examiner* — David Redding
(74) *Attorney, Agent, or Firm* — Sheridan Ross P.C.

(57) ABSTRACT

The invention relates to a floor treatment system, comprising a mobile floor treatment apparatus and a docking station therefor, wherein the floor treatment apparatus has at least one liquid container with a container wall and a container interior, wherein the docking station comprises at least one supply conduit through which, in a docked position of the floor treatment apparatus on the docking station, a liquid is suppliable to the container interior, wherein the floor treatment system comprises an opening device by way of which a wall portion of the container wall is movable into an open position, for clearing at least one container opening of the at least one liquid container, and in the docked position of the floor treatment apparatus the liquid can exit from the container interior through the container opening, and wherein the wall portion is transferable into the open position by the (Continued)

opening device by moving the floor treatment apparatus from a non-docked position into the docked position.

29 Claims, 3 Drawing Sheets

(52) U.S. Cl.
CPC ..... *A47L 11/4083* (2013.01); *A47L 11/4091* (2013.01); *A47L 2201/024* (2013.01); *A47L 2201/026* (2013.01)

(56) References Cited

U.S. PATENT DOCUMENTS

| | | | |
|---|---|---|---|
| 7,891,387 | B2 | 2/2011 | Lim et al. |
| 8,776,305 | B2 | 7/2014 | Troff et al. |
| 9,687,131 | B2 | 6/2017 | Eidmohammadi et al. |

FOREIGN PATENT DOCUMENTS

| | | |
|---|---|---|
| CN | 101057767 | 10/2007 |
| CN | 101254080 | 9/2008 |
| CN | 201572039 | 9/2010 |
| CN | 102357480 | 2/2012 |
| CN | 103200852 | 7/2013 |
| CN | 104010485 | 8/2014 |
| CN | 204860064 | 12/2015 |
| CN | 106470584 | 3/2017 |
| DE | 4230197 | 3/1994 |
| DE | 102005045669 | 3/2007 |
| DE | 102010038422 | 1/2012 |
| DE | 102014105460 | 10/2015 |
| EP | 1762165 | 3/2007 |
| EP | 2648307 | 10/2013 |
| KR | 10-2014-0036653 | 5/2014 |
| WO | WO 94/05197 | 3/1994 |
| WO | WO 2005/104921 | 11/2005 |
| WO | WO 2015/082017 | 6/2015 |

OTHER PUBLICATIONS

U.S. Appl. No. 16/178,909, filed Nov. 2, 2018, Blumhardt et al.
U.S. Appl. No. 16/178,933, filed Nov. 2, 2018, Wurm et al.
International Search Report for International (PCT) Patent Application No. PCT/EP2016/060060, dated Jan. 10, 2017, 2 pages.
International Search Report for International (PCT) Patent Application No. PCT/EP2017/059347, dated Jul. 25, 2017, 2 pages.
International Search Report for International (PCT) Patent Application No. PCT/EP2016/060077, dated Jan. 13, 2017, 2 pages.
International Search Report for International (PCT) Patent Application No. PCT/EP2016/060092, dated Jan. 17, 2017, 2 pages.
Translated International Preliminary Report on Patentability for International (PCT) Patent Application No. PCT/EP2016/060060, dated Nov. 15, 2018, 9 pages.
Translated International Preliminary Report on Patentability for International (PCT) Patent Application No. PCT/EP2017/059347, dated Nov. 15, 2018, 8 pages.
Translated International Preliminary Report on Patentability for International (PCT) Patent Application No. PCT/EP2016/060077, dated Nov. 15, 2018, 8 pages.
Translated International Preliminary Report on Patentability for International (PCT) Patent Application No. PCT/EP2016/060092, dated Nov. 15, 2018, 9 pages.
Official Action (with English translation) for Chinese Patent Application No. 201680084615.4, dated Jun. 3, 2020, 15 pages.
Official Action (with English translation) for Chinese Patent Application No. 201680084626.2, dated Jun. 17, 2020, 13 pages.
Official Action (with English translation) for Chinese Patent Application No. 201780023750.2, dated Jun. 4, 2020, 23 pages.
Official Action (with English translation) for Chinese Patent Application No. 201680086438.5, dated Jun. 30, 2020, 10 pages.

FLOOR TREATMENT SYSTEM

CROSS-REFERENCE TO RELATED APPLICATIONS

This application is a continuation application under 35 U.S.C. 111(a) of international application number PCT/EP2017/059347, filed Apr. 20, 2017, which claims the benefit of German application number 20 2016 102 396.3, filed May 4, 2016, the entire disclosures of which are hereby incorporated by reference.

FIELD OF THE INVENTION

The present invention relates to a floor treatment system, comprising a mobile floor treatment apparatus and a docking station therefor, wherein the floor treatment apparatus has at least one liquid container with a container wall and a container interior.

BACKGROUND OF THE INVENTION

The floor treatment system is for example a floor cleaning system, wherein the floor treatment apparatus takes the form of a floor cleaning apparatus. This may have at least one cleaning unit for cleaning the floor surface, to which a cleaning liquid (usually water) may be applied from the at least one liquid container for enhancing the cleaning effect.

However, also conceivable are floor treatment apparatuses and systems in which a liquid can be used that are constructed in other ways. Examples that may be mentioned here are in particular floor polishing systems, wherein the liquid may be a polishing agent.

The at least one liquid container may therefore be in particular a reservoir for the liquid. As the level of the liquid in the liquid container falls, the floor treatment apparatus may be transferred to a docked position on the docking station. In the docked position, liquid may be provided to the at least one liquid container. For example, a reservoir may be filled.

An object underlying the present invention to construct a floor treatment system of the type mentioned in the introduction that has greater operational safety.

SUMMARY OF THE INVENTION

In an aspect of the invention, a floor treatment system comprises a mobile floor treatment apparatus and a docking station therefor, wherein the floor treatment apparatus has at least one liquid container with a container wall and a container interior. The docking station comprises at least one supply conduit through which, in a docked position of the floor treatment apparatus on the docking station, a liquid is suppliable to the container interior. The floor treatment system comprises an opening device by way of which a wall portion of the container wall is movable into an open position, for clearing at least one container opening of the at least one liquid container. In the docked position of the floor treatment apparatus the liquid can exit from the container interior through the container opening. The wall portion is transferable into the open position by the opening device by moving the floor treatment apparatus from a non-docked position into the docked position.

BRIEF DESCRIPTION OF THE DRAWINGS

The foregoing summary and the following description may be better understood in conjunction with the drawing figures, of which.

DETAILED DESCRIPTION OF PREFERRED EMBODIMENTS OF THE INVENTION

Figure 1:
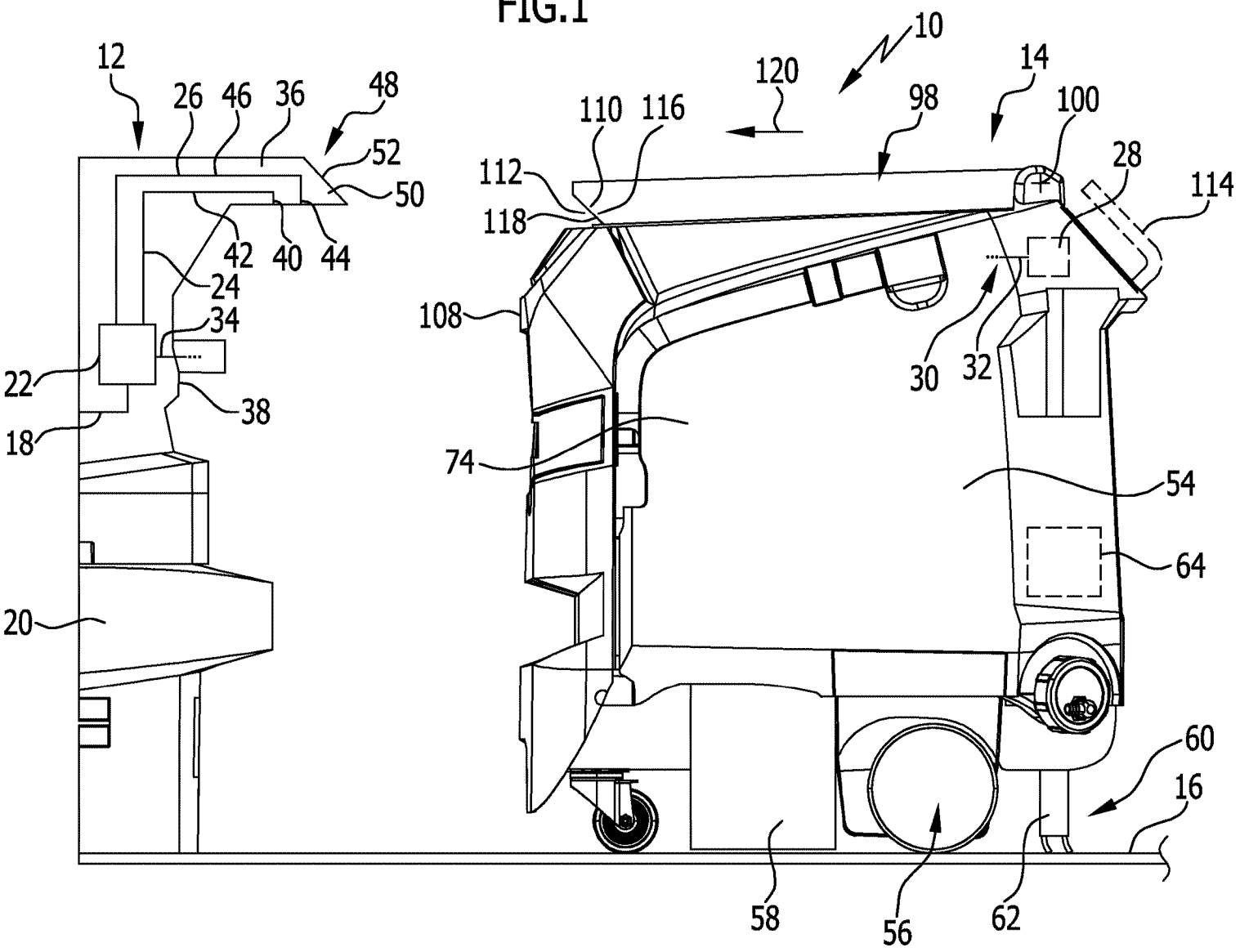
FIG. 1 shows a side view of a floor treatment system in accordance with the invention, having a docking station and a floor treatment apparatus adopting a non-docked position.

Although the invention is illustrated and described herein with reference to specific embodiments, the invention is not intended to be limited to the details shown. Rather, various modifications may be made in the details within the scope and range of equivalents of the claims and without departing from the invention.

The present invention relates to a floor treatment system, comprising a mobile floor treatment apparatus and a docking station therefor, wherein the floor treatment apparatus has at least one liquid container with a container wall and a container interior. The docking station comprises at least one supply conduit through which, in a docked position of the floor treatment apparatus on the docking station, a liquid is suppliable to the container interior. The floor treatment system comprises an opening device by way of which a wall portion of the container wall is movable into an open position, for clearing at least one container opening of the at least one liquid container. In the docked position of the floor treatment apparatus the liquid can exit from the container interior through the container opening. The wall portion is transferable into the open position by the opening device by moving the floor treatment apparatus from a non-docked position into the docked position.

In the floor treatment system in accordance with the invention, it is provided for a wall portion of the container wall to be able to adopt an open position when the floor treatment apparatus adopts the docked position. In the open position, at least one container opening of the liquid container is clear. This provides the possibility for example of venting the container interior when the liquid is supplied. If the level of liquid in the container interior rises too much, it may further be provided for liquid to be able to exit from the container interior through the container opening. In this way, the pressure in the container interior may be limited, and a backlog of liquid and backflow of liquid through the at least one supply conduit may be prevented. The supply conduit may be protected from ingress of germs or particles that are possibly present in the liquid container and liquid therein. This is in particular significant if the docking station is connected to a mains liquid supply network by the supply conduit. The wall portion is transferable into the open position by the opening device by moving the floor treatment apparatus from a non-docked position into the docked position. As the floor treatment apparatus is moved to the docking station for adopting the docked position, the wall portion may be transferred into the open position automatically and preferably without a drive. This ensures that the at least one container opening is already clear when the floor treatment apparatus is docked to the docking station. As a result, the floor treatment system in accordance with the invention has greater operational reliability than generic floor treatment systems.

In relation to the at least one liquid container, the wall portion may adopt a closed position in which the at least one container opening is preferably covered over and closed off.

In an advantageous embodiment of the floor treatment system, the floor treatment apparatus is favorably self-propelling and self-steering. By way of the floor treatment apparatus, which is configured as a robot, autonomous processing and in particular cleaning of the floor surface can be performed. The floor treatment apparatus may visit the docking station automatically, in particular, for filling a reservoir with the liquid.

As an alternative or in addition, it may be provided for the floor treatment apparatus to be guided manually. A manually guided floor treatment apparatus may be a ride-on apparatus and/or a walk-behind apparatus. An operator may transfer the floor treatment apparatus to the docked position on the docking station in particular for filling the liquid container. Optionally, the floor treatment apparatus may be provided with a drive for a travelling gear.

Depending on the mode of operation, it may be provided for the floor treatment apparatus to be operated in self-propelling and self-steering manner or with manual guidance.

In an advantageous embodiment of the floor treatment system, the floor treatment apparatus is preferably a floor cleaning apparatus and has at least one cleaning unit for cleaning a floor surface. For example, the floor cleaning apparatus is a scrubber/vacuum cleaner, and the cleaning unit has at least one roller-shaped or plate-shaped cleaning tool that is drivable in rotation. A dirt receiving device may be provided to transfer a mixture of cleaning liquid and dirt—the dirty liquid—to a dirty liquid container of the floor cleaning apparatus.

Favorably, the at least one container opening is an overflow opening. If the level of liquid rises as far as the rim of the at least one container opening, the liquid can exit from the container interior by overflowing.

It is advantageous if a rim of the at least one container opening runs at least in certain regions along an external contour of the floor treatment apparatus, formed by a housing of the floor treatment apparatus, so that the liquid can flow out over the outside of the housing. Leaking liquid can flow down the outside of the housing, and liquid can be prevented from flowing into the inside of the floor treatment apparatus. This enables any dirtying or damage by leaking liquid to be avoided.

In particular, a portion of the rim that is lowest is favorably arranged on the external contour of the floor treatment apparatus.

The opening device may take different forms. For example, a mechanical, electrical, hydraulic, pneumatic and/or magnetic opening device is provided. The opening device may take the form of an active component and comprise at least one drive or actuator to transfer the wall portion. The drive or actuator may act directly or indirectly on the wall portion. A restoring device may be provided to transfer the wall portion from the open position back into a closed position. The adoption of the docked position on the docking station may be detected by at least one sensor device.

The opening device may be arranged on or comprised by the floor treatment apparatus or the docking station. Also conceivable is an opening device in which the components are arranged on or comprised by both the docking station and the floor treatment apparatus.

In an advantageous embodiment of the floor treatment system, the opening device comprises an abutment or slide element on the station and a contact element on the wall portion, wherein the contact element couples to the abutment or slide element when the floor treatment apparatus is docked to the station. In this way, the wall portion may be transferred into the open position, in a simple construction and without a drive, in the event of movement from a non-docked position into the docked position. This already ensures at the time of docking that the at least one container opening is clear. The slide element may have a slide surface that is oriented at an angle to a direction in which the floor treatment apparatus is docked to the docking station.

Favorably, the slide element takes the form of a wedge shape. For example, the slide element may engage in an intermediate space between the wall portion and a housing portion of the floor treatment apparatus. On making contact with the slide element, the contact element may be acted upon by a force that opens the wall portion.

As an alternative or in addition it is advantageous if the slide element engages below the wall portion for transferring it into or keeping it in the open position. A configuration of this kind is particularly advantageous if the wall portion is formed or comprised by a cover wall and in particular a cover of the at least one liquid container.

Advantageously, in the docked position of the floor treatment apparatus the wall portion is kept in the open position by the opening device.

Advantageously, in the docked position of the floor treatment apparatus the wall portion is still kept in the open position if the liquid is not applied to the at least one liquid container through the supply conduit. Even if the floor treatment apparatus has been docked to the docking station but no liquid for the at least one liquid container is provided by way of the at least one supply conduit, the wall portion can adopt the open position for clearing the at least one container opening. Venting of the container interior and an exit of liquid continues to be possible in order to enhance the operational safety of the floor treatment system.

Preferably, at least one valve is positioned in the at least one supply conduit, wherein the at least one valve is actuatable for clearing and/or blocking the at least one supply conduit.

The at least one valve is preferably clearable or actuatable by a control device of the floor treatment system. The control device may be arranged in the floor treatment apparatus or in the docking station.

It may be provided for the at least one valve to be actuatable for clearing by moving the floor treatment apparatus into the docked position. Conversely, it may be provided for the at least one valve to be actuatable for blocking by moving the floor treatment apparatus out of the docked position and into a non-docked position.

The container wall may comprise a cover wall that comprises or forms the wall portion.

In an advantageous embodiment, the floor treatment apparatus has a cover of the at least one liquid container, which comprises or forms the wall portion. For this reason, the cover may, as a whole or in part, be a portion of the container wall. The above-mentioned cover wall may be formed by the cover.

It is favourable if the cover is raiseable away from a rim of the at least one container opening by the opening device, making it possible to clear the container opening. Correspondingly, it is advantageous if, in a closed position, the cover abuts against the rim of the at least one container opening, at least in certain regions, and covers over the container interior.

The wall portion, in particular the cover, may be mounted pivotally and/or displaceably for being pivoted open or slid open by the opening device. Preferably, the wall portion is mounted on a housing of the floor treatment apparatus.

In an advantageous embodiment, the wall portion is formed or comprised by a cover that can make contact, by a contact element, with a slide element of the opening device when the floor treatment apparatus rolls from a non-docked position into the docked position. By sliding on the docking station, the cover may be pivoted and hence the at least one container opening cleared.

It is favourable if the wall portion, in particular the cover, is transferable under the effect of gravity from the open position into a closed position in which the at least one container opening is covered over. This gives the floor treatment system a simple structural form. If the wall portion is not kept in the open position by the opening device, it returns to the closed position automatically, for example when the floor treatment apparatus is undocked from the docking station.

As an alternative or in addition, it may be provided for the wall portion to be transferable from the open position into a closed position using a restoring device.

In a structurally simple embodiment of the floor treatment system, it has proved favourable if the at least one supply conduit is received in a housing of the docking station.

It may be provided for the at least one supply conduit to be positioned, at least in certain regions, in a housing portion of the housing that is arranged above the at least one container opening when the floor treatment apparatus is in the docked position. The liquid can flow, by way of the at least one supply conduit, through the container opening from above and into the at least one liquid container.

In an advantageous embodiment of the floor treatment system, the above-mentioned abutment or slide element is preferably arranged on the housing portion. In particular, a slide surface for the wall portion may be formed on the housing portion.

It is advantageous if the at least one supply conduit has at least one outlet opening for liquid, and if, in the open position of the wall portion, the at least one outlet opening is positioned above a rim of the at least one container opening, in relation to a height direction. In this way, in the open position of the wall portion, the at least one outlet opening may be at a spacing from the rim and from the at least one container opening. If the level of the liquid in the container interior rises as far as the rim, this ensures that the liquid does not reach the at least one outlet opening. This enhances the operational reliability of the floor treatment apparatus, since it is not possible for any particles or germs to reach the at least one supply conduit and, in the worst case, result in contamination.

Indications of position and orientation such as "above", "below" or similar are to be understood in relation to a position of use of the floor treatment system on a set-down surface. The at least one outlet opening is thus positioned, in the height direction starting from the set-down surface, above the rim of the at least one container opening but not necessarily directly above the rim.

The at least one outlet opening is preferably positioned, in relation to a height direction, above a lowest position of the rim of the at least one container opening when the wall portion adopts the open position.

In an advantageous embodiment of the floor treatment system, there is provided as the liquid container a reservoir for a consumable liquid, and there is provided as the supply conduit a filling conduit for filling the reservoir with the consumable liquid. In the case of a floor treatment system, the consumable liquid may be for example a cleaning liquid, in particular water or a chemical cleaning agent. The cleaning liquid may be applicable to the floor surface, which may be cleaned using at least one cleaning unit. If the level of the consumable liquid exceeds a threshold level on filling, the consumable liquid may exit from the container interior through the container opening.

As an alternative or in addition, in an advantageous embodiment of the floor treatment system may be provided a dirty liquid container as the liquid container for receiving a dirty liquid, and a rinsing conduit as the supply conduit for rinsing the dirty liquid container. For example, in the case of a floor treatment apparatus a dirty liquid container may be provided into which the dirty liquid is transferred after being taken up from the floor surface. By way of the rinsing conduit, the rinsing liquid may be used, for example by a rinsing device of the floor treatment system, for rinsing the dirty liquid container. It may for example happen that an outlet or draining opening of the dirty liquid container is closed or blocked, with the result that when rinsing liquid is applied to the container interior the level thereof in the dirty liquid container rises. The dirty liquid can exit from the container interior through the at least one container opening.

The explanations above show that the floor treatment apparatus may comprise more than one liquid container.

In an advantageous embodiment, it is provided for the at least one supply conduit to branch at a switchable valve into a first supply conduit portion and a second supply conduit portion through which liquid is providable to a respective liquid container. The valve may be controlled for example by the above-mentioned control device of the floor treatment system. For example, a reservoir may be filled with a consumable liquid, or a dirty liquid container may be rinsed with a rinsing liquid.

As an alternative, it may be provided for the at least one supply conduit to branch into two supply conduit portions into each of which a valve is connected.

Further, it may be provided for two separate supply conduits to be provided, for applying liquid to a respective liquid container.

Preferably in the open position the wall portion clears the respective container opening of the liquid containers. A wall portion, in particular formed or comprised by a cover, may be provided as a constituent part of a respective container wall for more than one liquid container. By transferring only one wall portion, container openings of more than one liquid container may be cleared.

The container openings are preferably positioned laterally next to one another, wherein favorably in a closed position the wall portion abuts against a rim that encloses both container openings. In a closed position, the wall portion, in particular the cover, may cover over both container openings.

It may be provided for the container openings of two liquid containers to have a common rim portion. This rim portion may be the lowest rim portion of a rim of at least one container opening. This provides the possibility for example, for liquid from a first container interior to exit, and in particular to overflow, over the lowest rim portion into a further container interior.

FIG. 1 shows a preferred embodiment of a floor treatment system in accordance with the invention that bears the reference numeral 10 and is designated the system 10 below for the sake of simplicity. The system 10 comprises a docking station 12 and a mobile floor treatment apparatus 14, designated the apparatus 14 below for the sake of simplicity. The system 10 is positioned in a position of use on a set-down surface, which at the same time forms a floor surface 16 to be cleaned.

The docking station 12 comprises a supply conduit 18, which is connectable to a mains supply network. This is in particular a mains water supply network in order to bring water to the supply conduit 18. As explained below, water is both a reserve liquid and a rinsing liquid for the apparatus 14.

The docking station 12 comprises a housing 20 that receives the supply conduit 18. Further arranged in the housing 20 is a valve 22. At the valve 22, the supply conduit 18 branches into a first supply conduit portion 24 and a second supply conduit portion 26. It is also possible for the valve 22 to form two individual valves.

The valve 22 is controllable by a control device 28 of the system 10. In the present case, the control device 28 is arranged in the apparatus 14, but it could also be positioned in the docking station 12. By way of a control line 30, which has line portions 32, 34 that are electrically connected to one another when the apparatus 14 is in a docked position, the valve 22 may be switched such that liquid is optionally supplied to one or both of the supply conduit portions 24, 26.

Downstream of the valve 22, certain portions of the supply conduit portions 24, 26 are arranged in a housing portion 36. The housing portion 36 is formed on the upper side of the housing 20. The housing portion 36 projects beyond an end face 38 of the rest of the housing 20. The housing portion 36 may engage over the apparatus 14—a point discussed below—when the apparatus 14 is in a docked position on the docking station 12.

Indications of position and orientation such as "above", "below" or similar are to be understood in relation to the position of use of the system 10 on the floor surface 16.

An outlet opening 40 is formed at the end of the first supply conduit portion 24. The supply conduit 18 is operational, by way of the first supply conduit portion 24, as a filling conduit 42 for filling a reservoir of the apparatus 14.

At least one outlet opening 44 is formed on the second supply conduit portion 26. Preferably, at least one nozzle may be arranged on the outlet opening 44 in order to generate a flat or annular jet. The supply conduit 18 is operational, by way of the second supply conduit portion 26, as a rinsing conduit 46 for rinsing a dirty liquid container of the apparatus 14.

When the respective supply conduit portion 24 and 26 is acted upon, liquid can exit downwards from the respective outlet opening 40 and 44, in the direction of the floor surface 16.

Further, the docking station 12 comprises an opening device 48. As explained below, the opening device 48 serves to transfer a cover of the apparatus 14 into an open position and to keep the cover in the open position.

The opening device 48 has a slide element 50 that is for example arranged on or comprised by the housing 20. The slide element 50 is formed by a projection on the housing portion 36. The slide element 50 takes the form of a wedge shape and comprises a slide surface 52. In the present case, the slide surface 52 is oriented at an angle to a plane defined by the floor surface 16 and points upwards. If the floor surface 16 is assumed to be horizontal, this plane is a horizontal plane, so the slide surface 52 is oriented at an angle to the horizontal.

The apparatus 14 takes the form of a floor treatment apparatus and comprises a housing 54, on the underside of which there is arranged a travelling gear 56 for rolling on the floor surface 16. Further, a cleaning unit 58 is arranged on the housing 54 in order to clean the floor surface 16.

The apparatus 14 is a scrubber/vacuum cleaner, so the cleaning unit 58 has at least one brush-shaped or plate-shaped cleaning tool (not shown in the drawing) that is drivable in rotation. A further cleaning unit is provided on the apparatus 14 in the form of a dirt receiving device 60 (not illustrated in FIG. 3). The dirt receiving device 60 has a suction bar 62 and a suction unit 64 for applying negative pressure to the suction bar 62.

The apparatus 14 comprises a first liquid container 66, which is a reservoir 68 for a consumable and in particular cleaning liquid, specifically water. Further, the apparatus 14 comprises a second liquid container 70 for receiving dirty liquid, which may be rinsed by a rinsing liquid, in particular water. The second liquid container 70 is thus a dirty liquid container 72.

The housing 54 of the apparatus 14 comprises a so-called container-in-container concept, in which the dirty liquid container 72 is enclosed by the reservoir 68 surrounding it. Accordingly, the housing 54 takes a double-walled form with an outer wall 74 and an inner wall 76.

The reservoir 68 is delimited by a container wall 78 that comprises among other things the outer wall 74, the inner wall 76 and a base wall (not shown in the drawing). The container wall 78 delimits a container interior 80. Provided at the upper side of the reservoir 68 is a container opening 82 that has a rim 84. The rim 84 comprises a rim portion 86 along the external contour of the housing 54 and a rim portion 88 remote from the external contour of the housing 54.

The dirty liquid container 72 comprises a container wall 90 that comprises the inner wall 76 and a base wall (not shown in the drawing). The container wall 90 encloses a container interior 92. At the upper side, the dirty liquid container 72 has a container opening 94 that is enclosed by a rim 96. For the most part, the rim 96 runs along the external contour of the housing 54. A portion of the rim 96 is the rim portion 88 of the rim 84. As a result, the container opening 82 and the container opening 94 are separated from one another by the rim portion 88.

When the apparatus 14 is in operation, the cleaning liquid in the reservoir 68 may be applied to the floor surface 16, optionally and preferably mixed with a chemical cleaning agent. Dirt can be detached from the floor surface 16 using the cleaning unit 58. The dirty liquid can be taken up from the floor surface 16 by way of the dirt receiving apparatus 60 and deposited in the dirty liquid container 72.

As a constituent part of the housing 54, the apparatus 14 has a covering for the liquid containers 66, 70. The covering takes the form of the cover 98. In the present case, the cover 98 is held on the rest of the housing 54 such that it is pivotal about a pivot axis 100. The cover 98 can be flipped open and closed by being pivoted.

In the present case, the cover 98 forms a cover wall for both the reservoir 68 and the dirty liquid container 72. Accordingly, the cover 98 forms a constituent part of the container wall 78 of the reservoir 68, in the form of a wall portion 102. Further, the cover 98 forms a constituent part of the container wall 90 of the dirty liquid container 72, in the form of a wall portion 104.

At an underside the cover 98 has a peripheral rim 106. The rim 106 takes a form largely corresponding with the rim 96 of the container opening 94.

When the cover 98 is in a closed position, the rim 106 abuts against, and in particular lies on, the rim 96 and the rim portion 86 (FIG. 1). The cover 98 covers over the container opening 82, as a wall portion 102, and the container opening 94, as a wall portion 104. Both the reservoir 68 and the dirty liquid container 72 are closed.

Figure 2:
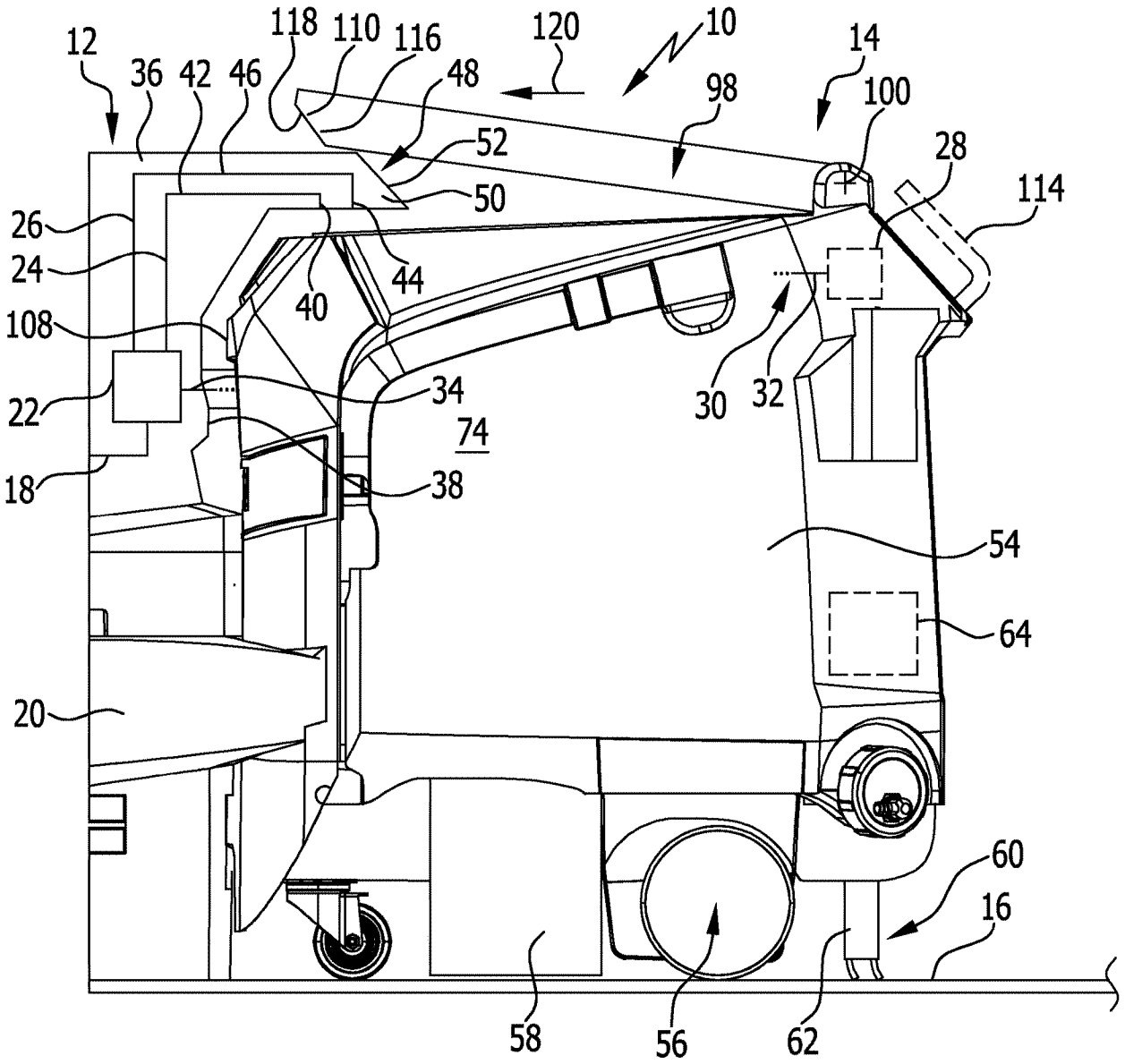
FIG. 2 shows the floor treatment system from FIG. 1, wherein the floor treatment apparatus adopts a docked position.
Figure 3:
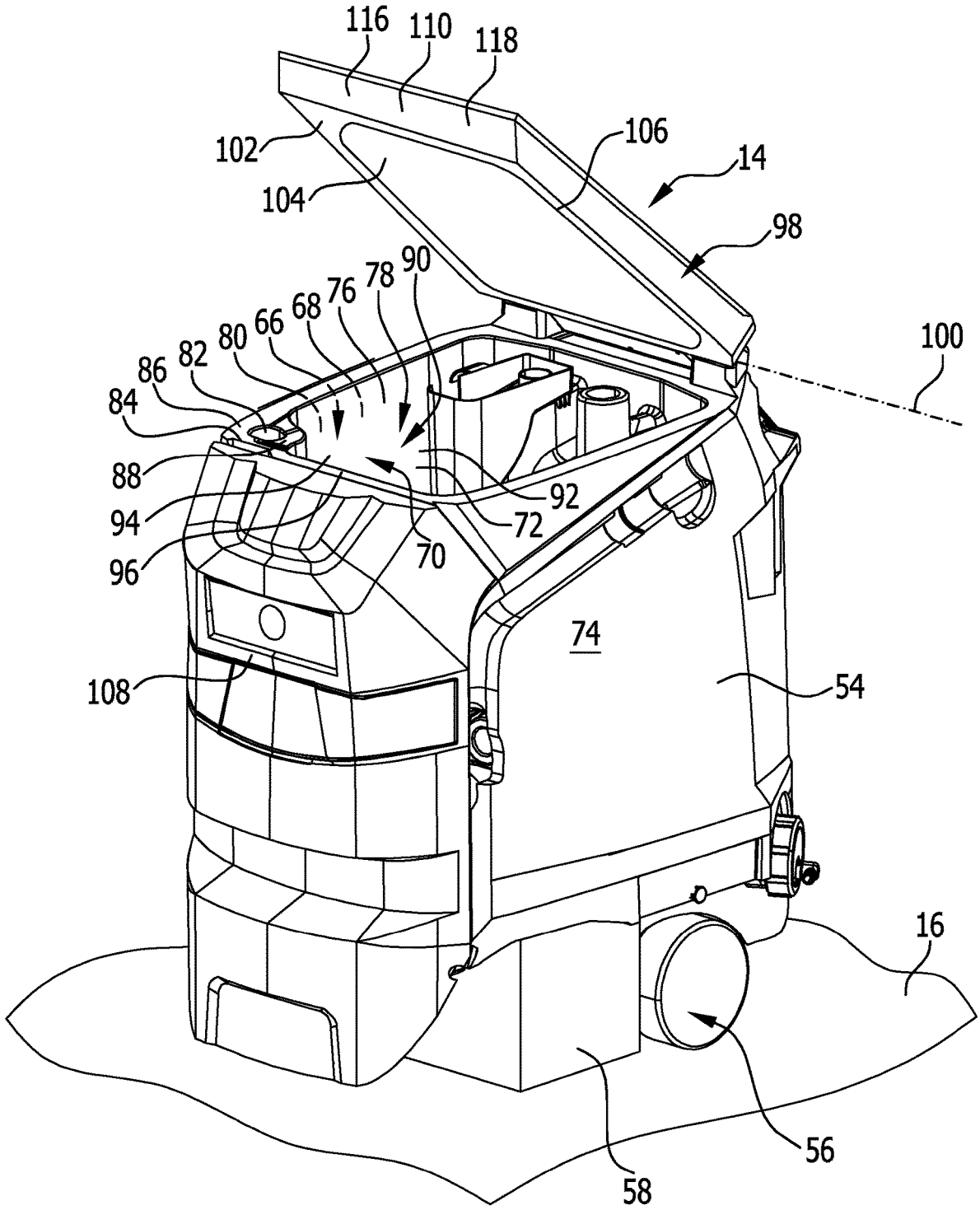
FIG. 3 shows a perspective (partial) illustration of the floor treatment apparatus from FIG. 1, having a cover adopting an open position.

By being pivoted about the pivot axis 100, the cover 98 can be transferred into an open position (FIGS. 2 and 3, with different positions of opening). In the open position, the rim 106 is raised away from the rim 96 and the rim portion 86, and the container openings 82 and 94 are cleared. This is particularly clearly visible in FIG. 3, but the container openings 82 and 94 are still cleared even with a relatively small pivot angle of the cover 98 in the position of opening of the cover 98 that is illustrated in FIG. 2.

The cover 98 has a wedge-shaped projection 110 arranged on the upper side of the cover 98, in the region of a front side 108 of the apparatus 14. Formed between the projection 110 and the housing 54, in particular at the rim 96, is an intermediate space 112. The intermediate space 112 is still present when the cover 98 adopts the closed position.

The term "front side" relates to a direction of longitudinal or principal movement of the apparatus 14. In the docked position of the apparatus 14, the front side 108 faces an end face of the docking station 12.

The apparatus 14 may be a self-propelling and self-steering floor treatment apparatus (a floor cleaning robot) by which the floor surface 16 may be cleaned autonomously. The control device 28 can control the movements of the apparatus 14, by control of a drive for the travelling gear 56 and also the cleaning units.

As an alternative or in addition, it may be provided for the apparatus 14 to be guided manually, and to be guided over the floor surface 16 by an operator. A drive for the travelling gear 56 may be provided. The operator may operate the apparatus 14 by way of a handle 114, which is illustrated schematically in the drawing and comprises in particular a gripping device.

For filling the reservoir 68 and rinsing the dirty liquid container 72, the apparatus 14 may be docked to the docking station 12. During this procedure, the apparatus 14 is moved, automatically or guided by the operator, from a non-docked position (FIG. 1) at a spacing from the docking station 12, to a docked position (FIG. 2).

During docking and on adopting the docked position, the opening device 48 is active so as to transfer the cover 98, and hence the wall portions 102, 104 of the container walls 78 and 90 respectively, from the closed position into an open position and to keep them there. Here, the slide element 50 engages in the intermediate space 112 during docking (and also in the docked position). A contact element 116, which is formed by the projection 110, makes contact with the slide surface 52 of the slide element 50 by means of a corresponding slide surface 118.

During docking the apparatus 14 in a docking direction 120, in the present case parallel to the floor surface 16 and hence horizontally, the contact element 116 as a result slides over the slide element 50. An opening force is applied to the cover 98 and hence the wall portions 102, 104 for pivoting them about the pivot axis 100. The rim 106 is raised away from the rim 96 and the rim portion 86, and the container openings 82 and 94 are cleared. The wall portions 102, 104 adopt an open position.

The housing portion 36 engages over part of the apparatus 14, in the region of the container opening 82 and the container opening 94. In the open position of the wall portions 102, 104, the outlet opening 40 is arranged at a spacing from the container opening 82. Correspondingly, the outlet opening 44 of the rinsing conduit 46 is arranged at a spacing from the container opening 94. This respectively means in particular that, in relation to a height direction, the outlet openings 40, 44 are at a respective spacing from the rim 84 and 96 respectively, and hence from a respective liquid level that can reach the rims 84 and 96.

The system 10 in accordance with the invention has enhanced operational safety.

When the apparatus 14 adopts the docked position, with the valve 22 switched to the appropriate position by the control device 28, it is possible in particular for the reservoir 68 to be filled with the reserve liquid. The supply conduit 18 is operational, by way of the supply conduit portion 24, as a filling conduit 42. The outlet opening 40 is at a spacing in relation to the rim 84, and the reservoir 68 is filled both over a free path passing through the air and also through the container opening 82.

The container opening 82 that is clear in the open position of the wall portion 102 makes it possible to vent the reservoir 68 during filling, for limiting pressure. This limits the pressure in the reservoir 68, which is protected for example from bursting. A backlog of liquid to the supply conduit 18 is avoided. The liquid level can rise until the reserve liquid exits at the rim 84 from the container interior 80. Here, the outlet opening 40 is at a spacing from the maximum liquid level. This avoids a possible risk of contamination of the supply conduit 18 by particles and/or germs in the liquid in the reservoir 68.

The container opening 82 is an overflow opening. The liquid can overflow over the rim portion 88, which is lower down than the rim portion 86, wherein overflowing reserve liquid is collected in the container interior 92 of the dirty liquid container 72. This prevents overflowing reserve liquid from reaching the interior of the housing 54 and making it dirty or damaging it.

The valve 22 may further be switched such that the dirty liquid container 72 is rinsed with rinsing liquid. The supply conduit 18 is operational, by way of the supply conduit portion 26, as a rinsing conduit 46. Preferably, dirty liquid received in the container interior 92 is previously removed through an outlet or draining opening (not illustrated in the drawing), for example the dirty liquid is drained off to the docking station 12.

During rinsing of the dirty liquid container 72, the rinsing liquid is applied to the container interior 92. If the outlet or draining opening is closed or blocked, the liquid level in the container interior 92 can rise. This liquid level can also rise as a result of overflowing reserve liquid, as mentioned, from the reservoir 68.

In the open position of the wall portion 104, the container opening 94 is cleared for venting, in order to prevent a rise in pressure in the container interior 92, a backlog of liquid to the supply conduit 18 and bursting of the dirty liquid container 72.

The container opening 94 is likewise an overflow opening. If the liquid level in the container interior 92 reaches the rim 96, the liquid can exit from the container interior 92 and in particular overflow. It is advantageous if the liquid can flow down the external contour of the housing 54 and so does not reach the interior of the housing 54.

In the open position of the wall portion 104, the outlet opening 44 is arranged at a spacing from the rim 96. This makes it possible to avoid contact between the rinsing conduit 46 and liquid contaminated by any particles and/or germs in the container interior 92. In this case too, contamination of the supply conduit 18 is avoided.

The cover 98 and hence the wall portions 102, 104 may be transferred from the open position back into the closed position automatically. When the apparatus 14 is undocked from the docking station 12, the cover 98 pivots again under the effect of gravity about the pivot axis 100 until the rim 106 lies on the rim 96 and the rim portion 86, and closes off both liquid containers 66, 70.

REFERENCE NUMERALS

10 Floor treatment system
12 Docking station
14 Apparatus
16 Floor surface
18 Supply conduit
20 Housing
22 Valve
24 Supply conduit portion
26 Supply conduit portion
28 Control device
30 Control line
32 Line portion
34 Line portion
36 Housing portion
38 End face
40 Outlet opening
42 Filling conduit
44 Outlet opening
46 Rinsing conduit
48 Opening device
50 Slide element
52 Slide surface
54 Housing
56 Travelling gear
58 Cleaning unit
60 Dirt receiving device
62 Suction bar
64 Suction unit
66 Liquid container
68 Reservoir
70 Liquid container
72 Dirty liquid container
74 Outer wall
76 Inner wall
78 Container wall
80 Container interior
82 Container opening
84 Rim
86 Rim portion
88 Rim portion
90 Container wall
92 Container interior
94 Container opening
96 Rim
98 Cover
100 Pivot axis
102 Wall portion
104 Wall portion
106 Rim
108 Front side
110 Projection
112 Intermediate space
114 Handle
116 Contact element
118 Slide surface
120 Docking direction

What is claimed is:

1. A floor treatment system, comprising a mobile floor treatment apparatus and a docking station therefor, wherein the floor treatment apparatus has at least one liquid container with a container wall and a container interior, wherein the docking station comprises at least one supply conduit through which, in a docked position of the floor treatment apparatus on the docking station, a liquid is suppliable to the container interior, wherein the floor treatment system comprises an opening device by way of which a wall portion of the container wall is movable into an open position, for clearing at least one container opening of the at least one liquid container, so as to allow the liquid to exit from the container interior through the container opening in the docked position of the floor treatment apparatus, and wherein the wall portion is transferable into the open position by the opening device by moving the floor treatment apparatus from a non-docked position into the docked position.

2. A floor treatment system in accordance with claim 1, wherein the floor treatment apparatus is self-propelling and self-steering.

3. A floor treatment system in accordance with claim 1, wherein the floor treatment apparatus is guided manually.

4. A floor treatment system in accordance claim 1, wherein the floor treatment apparatus is a floor cleaning apparatus and has at least one cleaning unit for cleaning a floor surface.

5. A floor treatment system in accordance with claim 1, wherein the at least one container opening is an overflow opening.

6. A floor treatment system in accordance with claim 1, wherein a rim of the at least one container opening runs at least in certain regions along an external contour of the floor treatment apparatus, formed by a housing of the floor treatment apparatus, and wherein the liquid can flow out at the outside of the housing.

7. A floor treatment system in accordance with claim 1, wherein at least one of a mechanical, electrical, hydraulic, pneumatic and magnetic opening device is provided.

8. A floor treatment system in accordance with claim 1, wherein the opening device comprises an abutment or slide element on the docking station, and a contact element on the wall portion, wherein the contact element couples to the abutment or slide element when the floor treatment apparatus is docked to the docking station.

9. A floor treatment system in accordance with claim 8, wherein the slide element takes the form of a wedge shape and/or engages below the wall portion for transferring it into or keeping it in the open position.

10. A floor treatment system in accordance with claim 1, wherein in the docked position of the floor treatment apparatus the wall portion is kept in the open position by the opening device.

11. A floor treatment system in accordance with claim 1, wherein at least one valve is positioned in the at least one supply conduit, and wherein the at least one valve is actuatable for at least one of clearing and blocking the at least one supply conduit.

12. A floor treatment system in accordance with claim 11, wherein the at least one valve is clearable or actuatable by a control device of the floor treatment system.

13. A floor treatment system in accordance with claim 11, wherein the at least one valve is actuatable for clearing by moving the floor treatment apparatus into the docked position.

14. A floor treatment system in accordance with claim 1, wherein the container wall comprises a cover wall that comprises or forms the wall portion.

15. A floor treatment system in accordance with claim 1, wherein the floor treatment apparatus has a cover of the at least one liquid container, which comprises or forms the wall portion.

16. A floor treatment system in accordance with claim 15, wherein the cover is raiseable away from a rim of the at least one container opening by the opening device, and wherein, in a closed position, the cover abuts against the rim of the at least one container opening, at least in certain regions, and covers over the container interior.

17. A floor treatment system in accordance with claim 1, wherein the wall portion is mounted at least one of pivotally and displaceably for being pivoted open or slid open by the opening device.

18. A floor treatment system in accordance with claim 1, wherein the wall portion is transferable under the effect of gravity from the open position into a closed position in which the at least one container opening is covered over.

19. A floor treatment system in accordance with claim 1, wherein the wall portion is transferable from the open position into a closed position using a restoring device.

20. A floor treatment system in accordance with claim 1, wherein the at least one supply conduit is received in a housing of the docking station.

21. A floor treatment system in accordance with claim 20, wherein the at least one supply conduit is positioned, at least in certain regions, in a housing portion of the housing that is arranged above the at least one container opening when the floor treatment apparatus is in the docked position.

22. A floor treatment system in accordance with claim 21, wherein the opening device comprises an abutment or slide element on the docking station, and a contact element on the wall portion, wherein the contact element couples to the abutment or slide element when the floor treatment apparatus is docked to the docking station, the abutment or slide element being arranged on the housing portion.

23. A floor treatment system in accordance with claim 1, wherein the at least one supply conduit has at least one outlet opening for liquid, and wherein, in the open position of the wall portion, the at least one outlet opening is positioned above a rim of the at least one container opening, in relation to a height direction.

24. A floor treatment system in accordance with claim 1, wherein there is provided as the liquid container a reservoir for a consumable liquid, and wherein there is provided as the supply conduit a filling conduit for filling the reservoir with the consumable liquid.

25. A floor treatment system in accordance with claim 1, wherein there is provided as the liquid container a dirty liquid container for receiving a dirty liquid, and wherein there is provided as the supply conduit a rinsing conduit for rinsing the dirty liquid container.

26. A floor treatment system in accordance with claim 1, wherein the floor treatment apparatus comprises more than one liquid container.

27. A floor treatment system in accordance with claim 26, wherein the at least one supply conduit branches at a switchable valve into a first supply conduit portion and a second supply conduit portion through which liquid is providable to a respective liquid container.

28. A floor treatment system in accordance with claim 26, wherein in the open position the wall portion clears the respective container opening of the liquid containers.

29. A floor treatment system in accordance with claim 26, wherein the container openings are positioned laterally next to one another, and wherein in a closed position the wall portion abuts against a rim that encloses both container openings.

* * * * *